US006984150B2

(12) United States Patent
Kondou et al.

(10) Patent No.: US 6,984,150 B2
(45) Date of Patent: Jan. 10, 2006

(54) CABLE CONNECTOR

(75) Inventors: Takahiro Kondou, Shinagawa (JP); Mitsuru Kobayashi, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 10/901,983

(22) Filed: Jul. 30, 2004

(65) Prior Publication Data

US 2005/0191897 A1 Sep. 1, 2005

(30) Foreign Application Priority Data

Feb. 26, 2004 (JP) ..... 2004-051979

(51) Int. Cl.
*H01R 13/58* (2006.01)

(52) U.S. Cl. ..... 439/606; 439/497

(58) Field of Classification Search ..... 439/606, 439/604, 736, 76.1, 610
See application file for complete search history.

(56) References Cited

U.S. PATENT DOCUMENTS 5,192,229 A * 3/1993 Clark et al. ..... 439/604
5,470,238 A * 11/1995 Walden ..... 439/98
5,567,170 A * 10/1996 Kroeber ..... 439/186
5,885,108 A * 3/1999 Gerrans, Jr. ..... 439/606
5,926,952 A * 7/1999 Ito ..... 29/883
6,511,337 B1 * 1/2003 Fandrey et al. ..... 439/320
6,758,694 B2 * 7/2004 Liu ..... 439/606
6,790,087 B2 * 9/2004 Ho ..... 439/606

FOREIGN PATENT DOCUMENTS

JP 2003-059593 2/2003

* cited by examiner

*Primary Examiner*—Gary Paumen
(74) *Attorney, Agent, or Firm*—Staas & Halsey LLP

(57) ABSTRACT

A cable connector includes a contact assembly body having a structure where a contact is provided in an electric insulating block body, a relay board connected to the contact and provided at a back surface side of the contact assembly body, an electric wire arranging member which is provided at an end side of the relay board and which is configured to arrange a plurality of covering electric wires extended from an end of a cable in an arranging direction of the contact. A wire which is extended from an end of an electric insulating covering part of the covering electric wire is provided at an end of the cable so as to mechanically and electrically connect to the relay board. The electric wire arranging member has a synthetic resin receiving part configured to receive molten synthetic resin. The synthetic resin receiving part is provided at a side facing a part connected to the wire, of the electric wire arranging member. A synthetic resin part for reinforcing is formed into the synthetic resin receiving part by solidifying the molten synthetic resin. The synthetic resin part for reinforcing covers a part where the wire is connected, and fixes the end of the electric insulating covering part of the covering electric wire to the relay board.

10 Claims, 12 Drawing Sheets

RELATED
ART

CABLE CONNECTOR

BACKGROUND OF THE INVENTION

1. Field of the Invention

The present invention generally relates to cable connectors such as balanced transmission cable connectors, and more particularly, to a cable connector such as a balanced transmission cable connector which is suitable for transmitting high speed signals.

2. Description of the Related Art

There are two data transmission methods. One is a normal transmission method and the other is a balanced transmission method. In the normal transmission method, one electric wire is used for every datum. To the contrary, in the balanced transmission method, a pair of electric wires is used for every datum. A "+" signal and a "−" signal are simultaneously transmitted in the balanced transmission method. The magnitude of the "−" signal is equal to that of the "+" signal. The direction of the "−" signal is reverse to that of the "+" signal. Use of the balanced transmission method is on the increase for data transmission because the balanced transmission method has an advantage in that it is more robust against noise than the normal transmission method. A balanced transmission cable connector has a structure where a plug is provided at an end of a balanced transmission cable and the plug is covered with a shield cover. The balanced transmission cable connector is applied to the balanced transmission method and used for connecting a computer and a server.

FIG. 1 is an exploded perspective view of a related art balanced transmission cable connector 10. FIG. 2 is a cross-sectional view of the balanced transmission cable connector 10 shown in FIG. 1. In FIG. 1 and FIG. 2, a direction of X1–X2 shows a width direction of the balanced transmission cable connector 10. A direction of Y1–Y2 shows a longitudinal direction of the balanced transmission cable connector 10. A direction of Z1–Z2 shows a height direction of the balanced transmission cable connector 10. A direction of Y1 shows a rear direction and a direction of Y2 shows a front direction. FIG. 3 is a cross-sectional view of a related art balanced transmission cable 20. The balanced transmission cable connector 10 is connected to an end part of the balanced transmission cable 20 having a structure shown in FIG. 3-(A) and FIG. 3-(B).

As shown in FIG. 3-(A), the balanced transmission cable 20 has a structure where a lot of pair electric wires 21 are arranged inside of a tube which has a double covering structure formed by a tube-shaped electrically insulating outer covering part 27 and a shielding mesh 28. As shown in FIG. 3-(B), each of the pair electric wires 21 has a structure where a pair of first and second covered signal electric wires 22-1 and 22-2 and a drain wire 26 are wound in a spiral form by a metal tape 25 so as to be bound. The first and second covered signal electric wires 22-1 and 22-2 and the drain wire 26 are extended from an end part of the pair electric wire 21 to the outside. Head end parts of the first and second covered signal electric wires 22-1 and 22-2 are processed so that first and second signal wires 23-1 and 23-2, respectively, are exposed in a naked state. The first and second covered signal electric wires 22-1 and 22-2 include electrically insulating covering parts 24-1 and 24-2, respectively. The first and second covered signal electric wires 22-1 and 22-2 form a pair wire. In addition, as shown in FIG. 2, an end part of the balanced transmission cable 20 is clamped by a clamp member 27.

Referring back to FIG. 1 and FIG. 2, a relay board 12 is fixed to a Y1 side of a plug assembly 11. The pair electric wires 21 provided at the end part of the balanced transmission cable 20 are arranged in X directions by an electric wire arranging member 15. The first and second covering signal electric wires 23-1 and 23-2 and the drain wire 26, which are further extended from the ends of the pair electric wires 21, are solder-connected to a terminal part situated at the Y1 side of the relay board 12, as shown by a numerical reference 14. Shield covers 31 and 32 cover the plug assembly 11, the relay board 12 and the electric wire arranging member 15. The shield covers 31 and 32 are engaged with the clamp member 27. The plug assembly 11 and the clamp member 27 limit movement in the Y1 direction. A synthetic resin part 16 is a part where synthetic resin in a molten state is solidified after a signal wire or the like is soldered. The synthetic resin part 16 covers a part where the first and second covering signal electric wires 23-1 and 23-2 and the drain wire 26 are soldered and connected to the terminal part at the Y1 side of the relay board 12, so that a solder connecting part 14 is reinforced. See Japanese Laid-Open Patent Application No. 2003-59593.

In the balanced transmission cable connector 10, the clamp member 27 is fixed to the shield covers 31 and 32. The balanced transmission cable connector 10 has a structure where even if the balanced transmission cable connector 10 is inserted into or pulled out from a socket of the computer so that the balanced transmission cable 20 is curved, there is no influence of the curve to an inside of the balanced transmission cable connector 10, more specifically to the solder connecting part 14.

However, the pair electric wires 21 are bound by a tube and therefore not fixed to each other. Accordingly, in a case where, for example, a clamp force by the clamp member 27 is not sufficient, if the balanced transmission cable 20 is pulled and curved, a pulling force of a certain pair electric wire 21 is transferred to even the inside of the balanced transmission cable connector 10 via the clamp member 27.

The synthetic resin part 16 is situated on only the upper surface and the lower surface of the relay board 12. Therefore, the pulling force transferred via the clamp member 27 reaches to the solder connecting part 14 covered by the synthetic resin part 16, via the electric wire arranging member 15. As a result of this, a stress is applied to the solder connecting part 14.

SUMMARY OF THE INVENTION

Accordingly, it is a general object of the present invention to provide a novel and useful cable connector.

Another and more specific object of the present invention is to provide a cable connector whereby the strength of a solder connecting part to a relay board of a wire is improved.

The above object of the present invention is achieved by a cable connector, including:

a contact assembly body having a structure where a contact is provided in an electric insulating block body;

a relay board connected to the contact and provided at a back surface side of the contact assembly body;

an electric wire arranging member which is provided at an end side of the relay board and which is configured to arrange a plurality of covering electric wires extended from an end of a cable in an arranging direction of the contact;

wherein a wire which is extended from an end of an electric insulating covering part of the covering electric wire is provided at an end of the cable so as to mechanically and electrically connect to the relay board, the electric wire arranging member has a synthetic resin receiving part configured to receive molten synthetic resin, the synthetic resin receiving part is provided at a side facing a part connected to the wire, of the electric wire arranging member, a synthetic resin part for reinforcing is formed into the synthetic resin receiving part by solidifying the molten synthetic resin, and the synthetic resin part for reinforcing covers a part where the wire is connected, and fixes the end of the electric insulating covering part of the covering electric wire to the relay board.

According to the above-mentioned invention, the synthetic resin part for reinforcing is formed in the synthetic resin receiving part of the electric wire arranging member so as to cover a part where the wire is connected and fix an end part of the covering part of the covering signal electric wire to the relay board. Therefore, in a case where the cable is pulled and curved, even if a pulling force is transferred to the inside of the cable connector via the covering signal electric wire, the pulling force is securely received by the synthetic resin part for reinforcing which fixes the end part of the covering part to the relay board. Hence, it is possible to prevent the part where the wire is connected from being given influence.

Other objects, features, and advantages of the present invention will become more apparent from the following detailed description when read in conjunction with the accompanying drawings.

DETAILED DESCRIPTION OF THE PREFERED EMBODIMENTS

A description is given below, with reference to the FIG. 4 through FIG. 12, of embodiments of the present invention.

Figure 4:
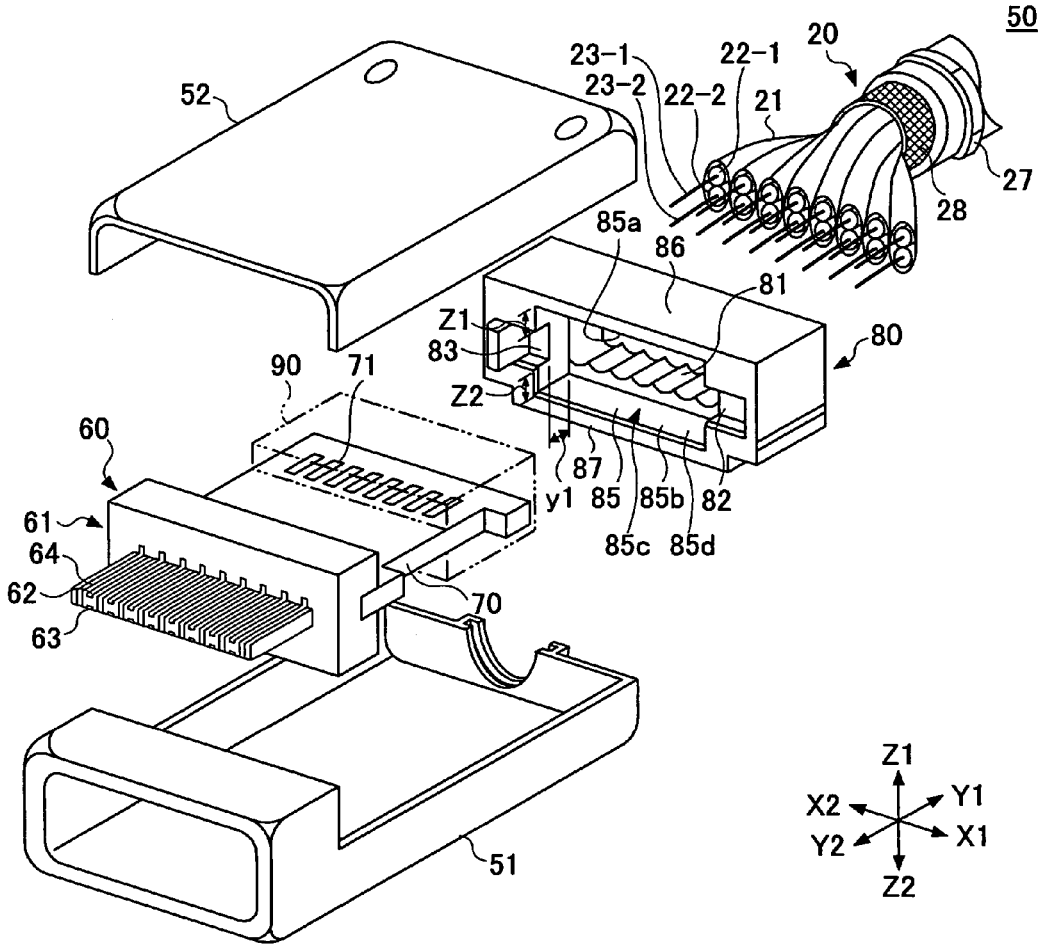
FIG. 4 is an exploded perspective view of a balanced transmission cable connector of a first embodiment of the present invention.
Figure 5:
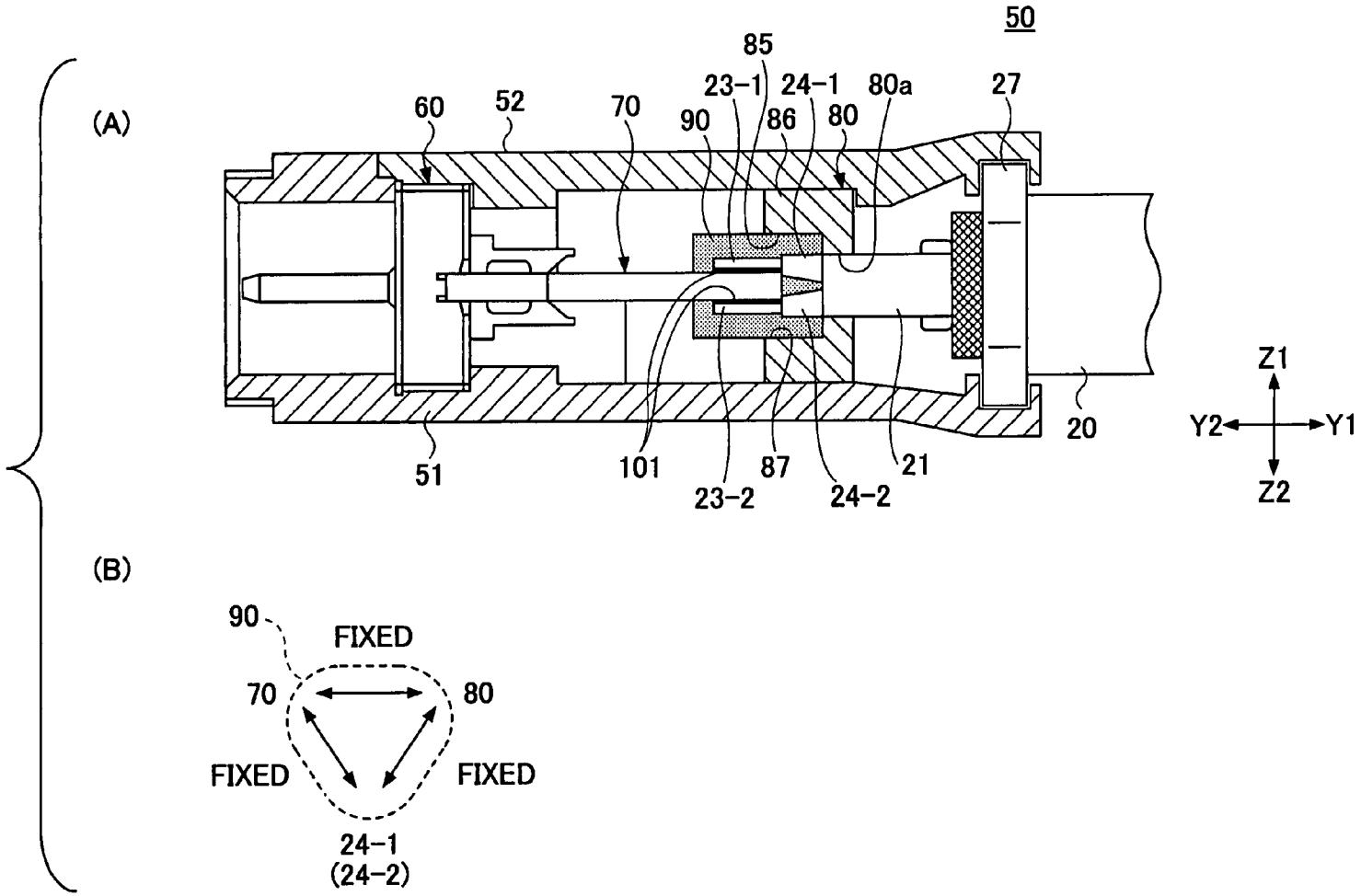
FIG. 5 is a cross-sectional view of the balanced transmission cable connector shown in FIG. 4.

FIG. 4 is an exploded perspective view of a balanced transmission cable connector 50 of a first embodiment of the present invention. FIG. 5 is a cross-sectional view of the balanced transmission cable connector 50 shown in FIG. 4. In FIG. 4 and FIG. 5, a direction of X1–X2 shows a width direction of the balanced transmission cable connector 50. A direction of Y1–Y2 shows a longitudinal direction of the balanced transmission cable connector 50. A direction of Z1–Z2 shows a height direction of the balanced transmission cable connector 50. A direction of Y1 shows a rear direction and a direction of Y2 shows a front direction.

Figure 1:
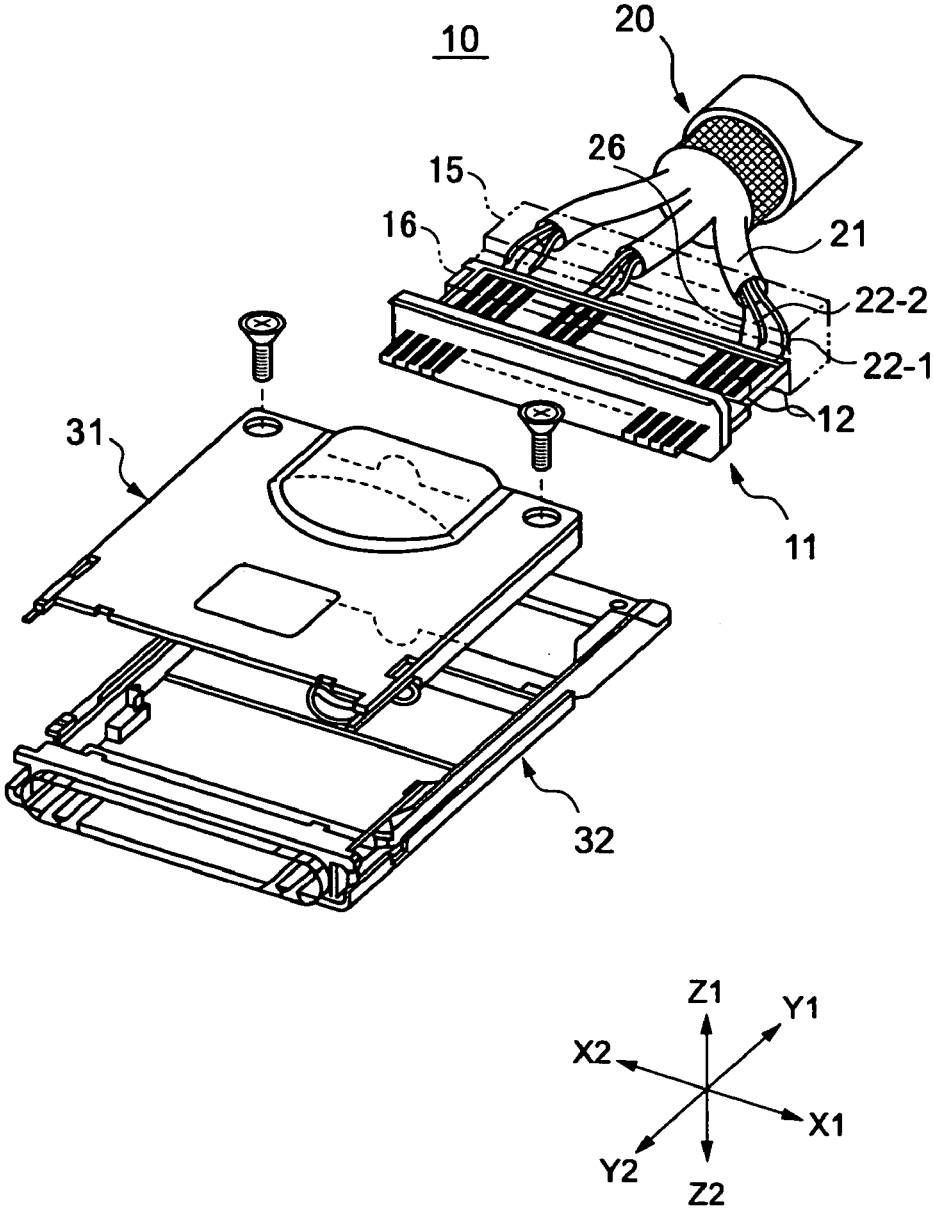
FIG.1 RELATED ART
FIG. 1 is an exploded perspective view of a related art balanced transmission cable connector 10.
Figure 2:
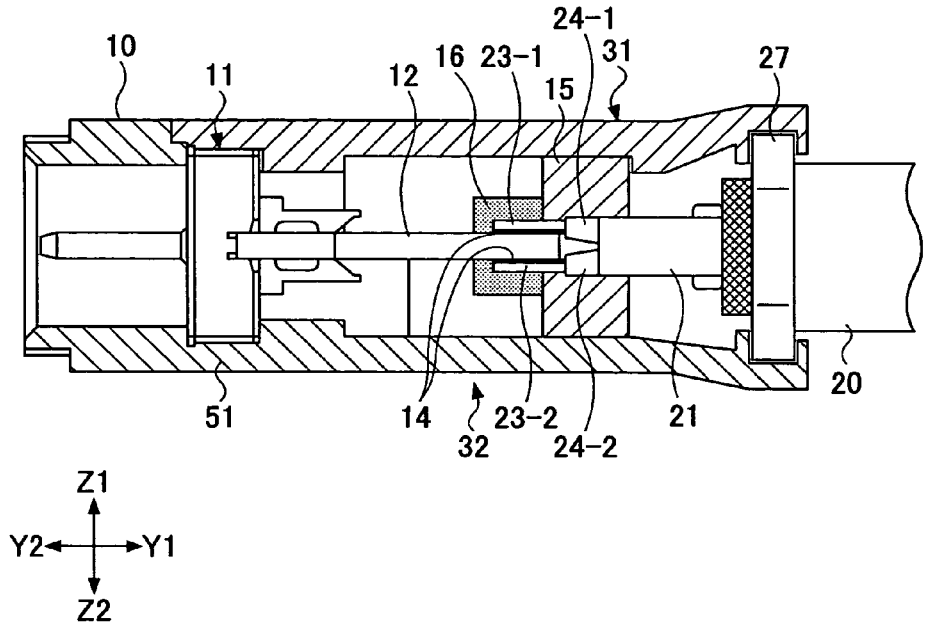
FIG.2 RELATED ART
FIG. 2 is a cross-sectional view of the balanced transmission cable connector 10 shown in FIG. 1.
Figure 3:
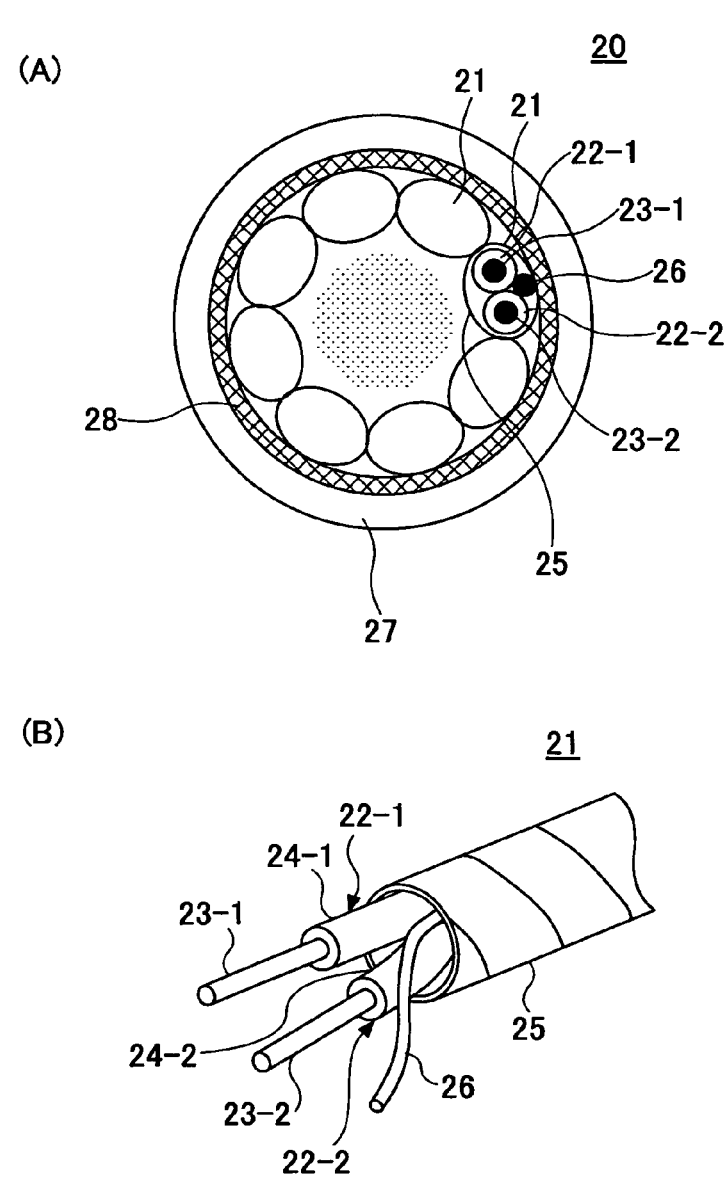
FIG. 3 is a cross-sectional view of a related art balanced transmission cable.

As shown in FIG. 4 and FIG. 5, the balanced transmission cable connector 50 has a structure where shield covers 51 and 52 cover a plug assembly body 60, a relay board 70, an electric wire arranging member 80 and an end part of the balanced transmission cable 20. The balanced transmission cable connector 50 connects to the end part of the balanced transmission cable 20. Roughly speaking, an area where a synthetic resin part 90 for reinforcing is formed of the balanced transmission cable connector 50 is different from the corresponding area of the cable connector shown 10 in FIG. 1 and FIG. 2.

The contact assembly body 60 has an electric insulating block body 61. A pair of a first signal contact 62 and a second signal contact 63 and a ground contact 64 are inserted in the block body 61 and arranged in the X direction in turn. A signal pattern and a ground pattern (not shown in FIG. 4 and FIG. 5) are formed on an upper surface and a lower surface of the relay board 70. Respective signal patterns are arranged in parallel in the Y direction. The signal patterns 71 are situated at both ends of the not shown signal patterns. The relay board 70 is engaged with a Y1 side of the contact assembly body 60. Ends at the Y1 side of the signal contacts 62 and 63 and the ground contact 64 are solder-attached to the signal patterns and ground pattern, respectively.

The electric wire arranging member 80 has a rectangular parallelepiped shape external configuration. A electric wire pair arranging part 81 configured to arrange the electric wire pair 21 is provided at the Y1 side of the electric wire arranging member 80.

A first concave part 82 and a second concave part 83 configured to engage with the relay board 70 are provided at the Y2 side and ends of X1 and X2 sides of the electric wire arranging member 80.

A third concave part 85 which functions as a synthetic resin receiving part is formed between the first concave part 82 and the second concave part 83. The third concave part 85 is mainly formed by a Z1 side flange part 86 and a Z2 side flange part 87. The third concave part 85 is a space forming part surrounded by a Z1 side internal surface 85*a*, a Z2 side internal surface 85*b*, and a Y1 side bottom surface 85*c*. An opening forming part 85*d* is formed at the Y2 side of the third concave part 85.

The third concave part 85 has a size sufficient to receive the relay board 70 in a state where signal wires 23-1 and 23-2 and a drain wire 26 are soldered. The length in the Z1 direction of the third concave part 85 is longer than the surface at the Z1 side of the first concave part 82 (second concave part 83) by z1. The length in the Z2 direction of the third concave part is longer than a surface at the Z2 side of the first concave part 82 (second concave part 83) by z2. The length in the Y1 direction of the third concave part is longer than the surface at the Y1 side of the first concave part 82 (second concave part 83) by y1.

The Y1 side bottom surface 85*c* is an end surface at the Y2 side of the pair electric wire arranging part 81. A plurality of pairs of half arc parts facing in the Z directions are arranged in the electric wire pair arranging part 81. A pair of the half arc parts facing in the Z directions form a configuration corresponding to a cross-sectional configuration of the electric wire pair 21 so that the position of the electric wire pair 21 passing through the half arc part is restrained.

Next, a structure of the balanced transmission cable connector 50 is discussed while manufacturing processes of the balanced transmission cable connector 50 are discussed.

Figure 6:
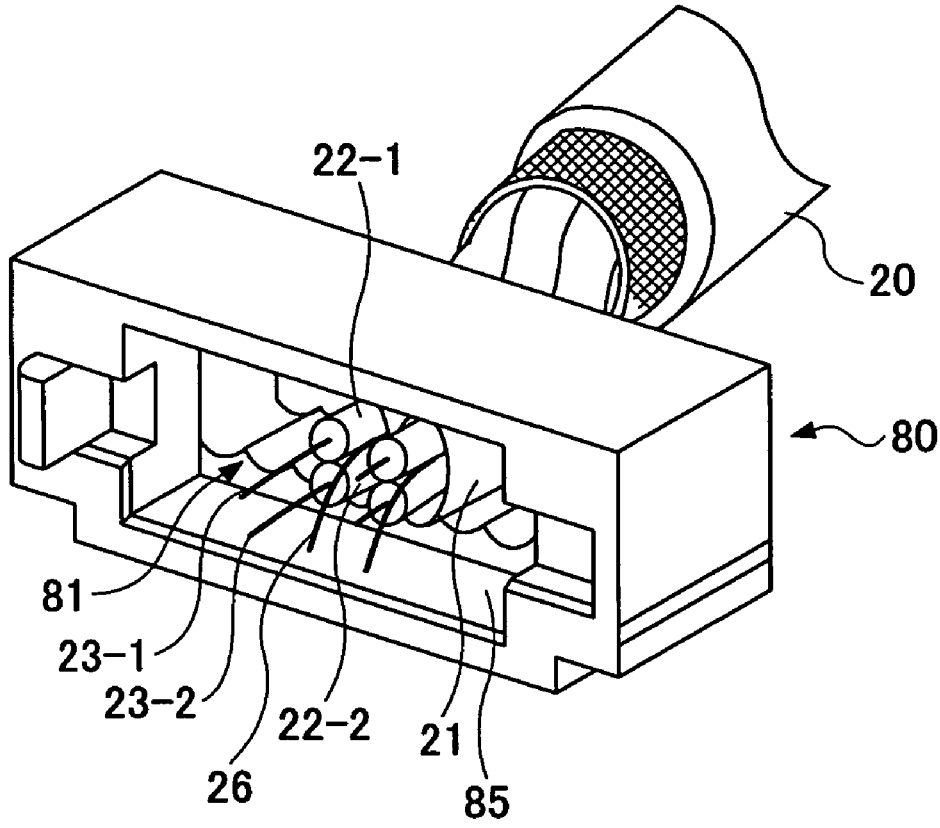
FIG. 6 is a view showing a state where pair electric wires provided at an end of the balanced transmission cable are arranged.

Processed end parts of the balanced transmission cable 20 are passed through the electric wire pair arranging part 81 of the electric wire arranging member 80 from the Y1 side so as to be arranged as shown in FIG. 6. The insulating covering parts 24-1 and 24-2 of first and second covered signal electric wires 22-1 and 22-2 are projected into the opening part 85*d*.

First, the Y1 end side of the relay board 70 connected to the contact assembly body 60 and the Y2 end side of the electric wire arranging member 80 where the electric wire pair 21 are arranged are combined while the Y1 end side of the relay board 70 is engaged with the first and second concave parts 82 and 83. Next, the first and second signal wires 23-1 and 23-2 and the drain wire 26 are soldered to the terminal part 71 situated at the Y1 side of the relay board 70, so that provisional assembly body 100 is completed at a first step. End parts of the insulating covering parts 24-1 and 24-2 and an end part of the Y1 side of the relay board 70 are inserted into the third concave part 85. Here, a numerical reference 101 represents a solder connecting part.

Figure 7:
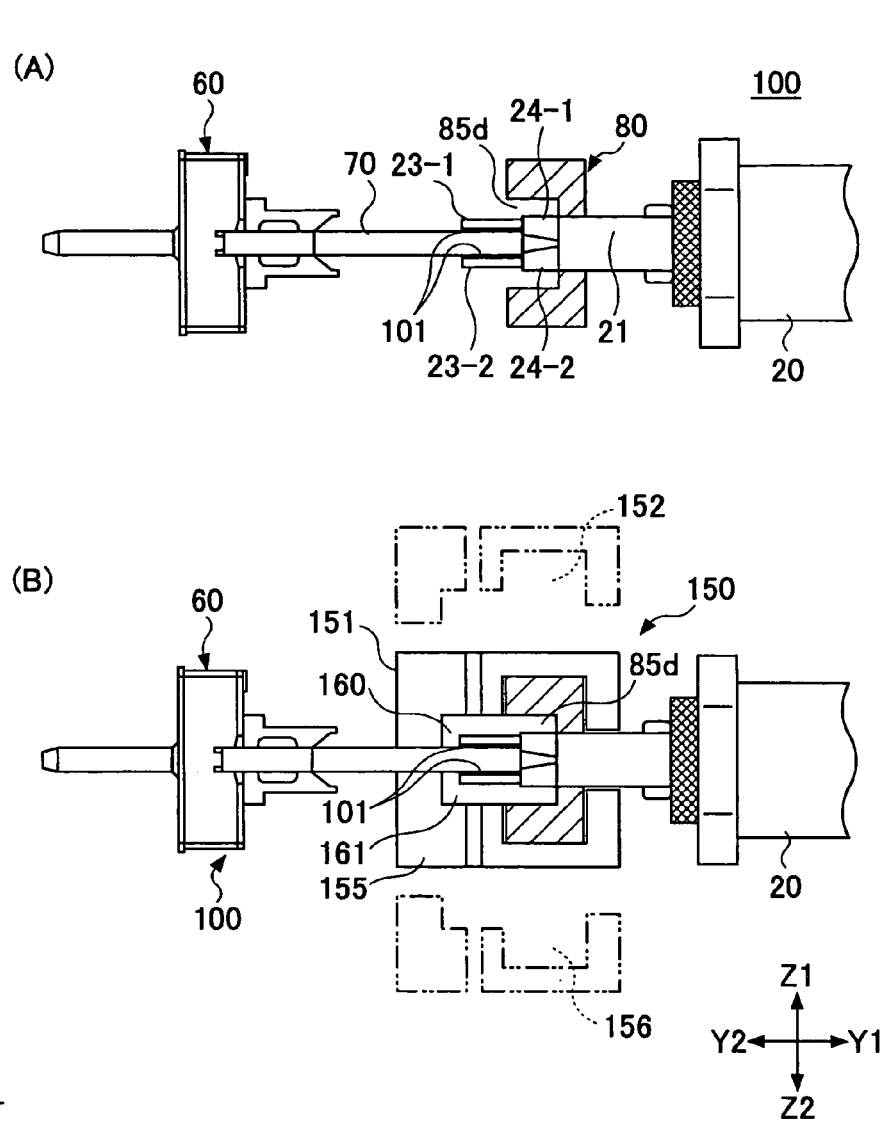
FIG. 7 is a first view for explanation of manufacturing processes of the balanced transmission cable connector shown in FIG. 4.

Next, as shown in FIG. 7-(B), the provisional assembly body 100 is set to a jig 150 for molding a synthetic resin part 90 (not shown in FIG. 7-(B)) for reinforcing. The jig 150 includes an upper mold 151 having a fourth concave part 152 and a lower mold 155 having a fifth concave part 156. By the jig 150, the electric wire arranging member 80 of the provisional assembly body 100 and a part of the Y1 side of the relay board 70 are put between the upper mold 151 and the lower mold 155. As a result of this, cavity forming parts 160 and 161 surround parts of the first and second signal wires 23-1 and 23-2 and the drain wire 26, which are solder-connected to the relay board 12 and the solder connecting part 101. Furthermore, the cavity forming parts 160 and 161 communicate with the Z1 side and Z2 side, respectively, of the opening part 85*d*.

Figure 8:
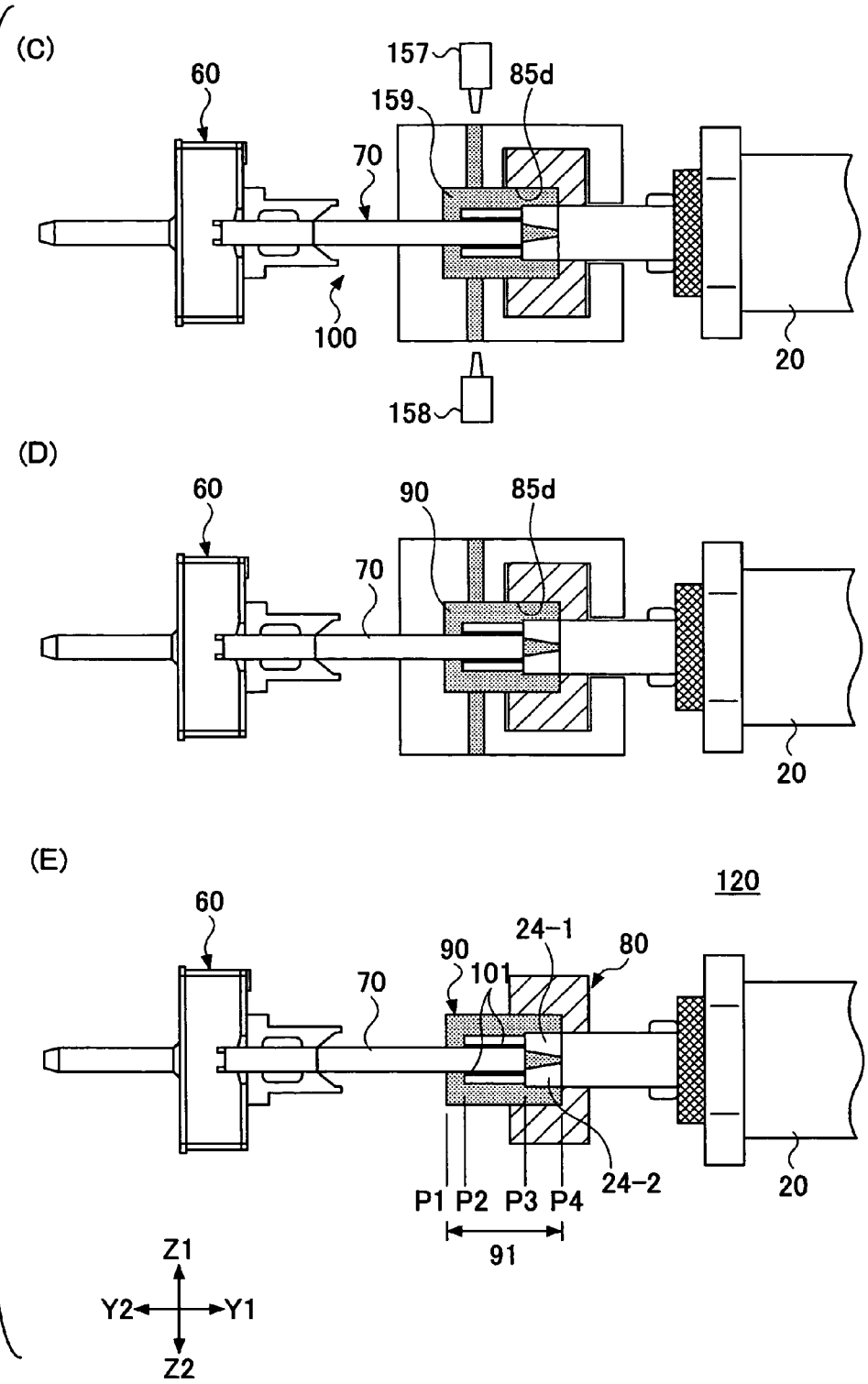
FIG. 8 is a second view for explanation of manufacturing processes of the balanced transmission cable connector shown in FIG. 4.

Next, as shown in FIG. 8-(C), a thermoplastic resin 159 such as polyimide, which is heated at approximately 100° C. and molten, is injected from holes of the upper mold 151 and the lower mold 155 by using syringes 157 and 158. As a result of this, insides of the cavity forming parts 160 and 161 are filled with the molten thermoplastic resin 159. Furthermore, the molten thermoplastic resin 159 enters into the opening part 85*d* so that the opening part 85*d* is filled with the molten thermoplastic resin 159. In addition, parts at end sides of the first and second covering signal electric wires 22-1 and 22-2 are surrounded by the molten thermoplastic resin 159. After the injected resin is cooled so as to have a normal temperature and be solidified, the synthetic resin part 90 for reinforcing is formed as shown in FIG. 8-(D).

After the jig 150 is opened, as shown in FIG. 8-(E), a provisional assembly body 120 at a second step where the synthetic resin part 90 for reinforcing is formed is picked up. The synthetic resin part 90 for reinforcing situated in a area 91 from a position P1 of the relay board 70 which is further to the Y2 side than a position P2 of head ends of the first and second signal wires 23-1 and 23-2 and the drain wire 26 to a position P4 which is the inner part of the opening part 85*d* of the electric wire arranging member 80, via the solder connecting part 101 and a position P3 of the head ends of the electrically insulating covering parts 24-1 and 24-2.

Therefore, the solder connecting part 101 is covered with the synthetic resin part 90 for reinforcing. Furthermore, as shown in FIG. 5-(B), the relay board 70, the electric wire arranging member 80, and the end parts of the covering parts 24-1 and 24-2 of the first and second covered electric signal wires 22-1 and 22-2 are fixed to each other. That is, the end parts of the covering parts 24-1 and 24-2 are fixed to both the relay board 70 and the electric wire arranging member 80. The electric wire arranging member 80 is fixed to the relay board 70. The electric wire arranging member 80 is fixed to the relay board 70.

Last, as shown in FIG. 5, the shield covers 51 and 52 cover the provisional assembly body 110 at the second step and the clamp member 27 is engaged with the provisional assembly body 110. As a result of this, the balanced transmission cable connector 50 is completed. In the cable connector 50, by the synthetic resin part 90 for reinforcing, the end parts of the covering parts 24-1 and 24-2 are fixed to the relay board 70 and the electric wire arranging member 80, and the electric wire arranging member 80 is fixed to the relay board 70.

In a case where the balanced transmission cable 20 is pulled and curved during the use of the cable connector 50, even if a pulling force of a certain electric wire pair 21 is transferred to even the inside of the balanced transmission cable connector 50 via the clamp member 27, the pulling force is received by head end parts of the covering parts 24-1 and 24-2 of the first and second covered electric signal wires 22-1 and 22-2, namely a front side of the solder connecting part 101. Therefore, the pulling force does not reach the solder connecting part 101. Furthermore, the arranging member 80 does not independently slide against the relay board 70. A stress to the soldering part due to the arranging member 80 independently sliding against the relay board 70 does not occur. Therefore, the balanced transmission cable connector 50 has a higher reliability regarding the solder connection part 101 than the related art connectors.

Figure 9:
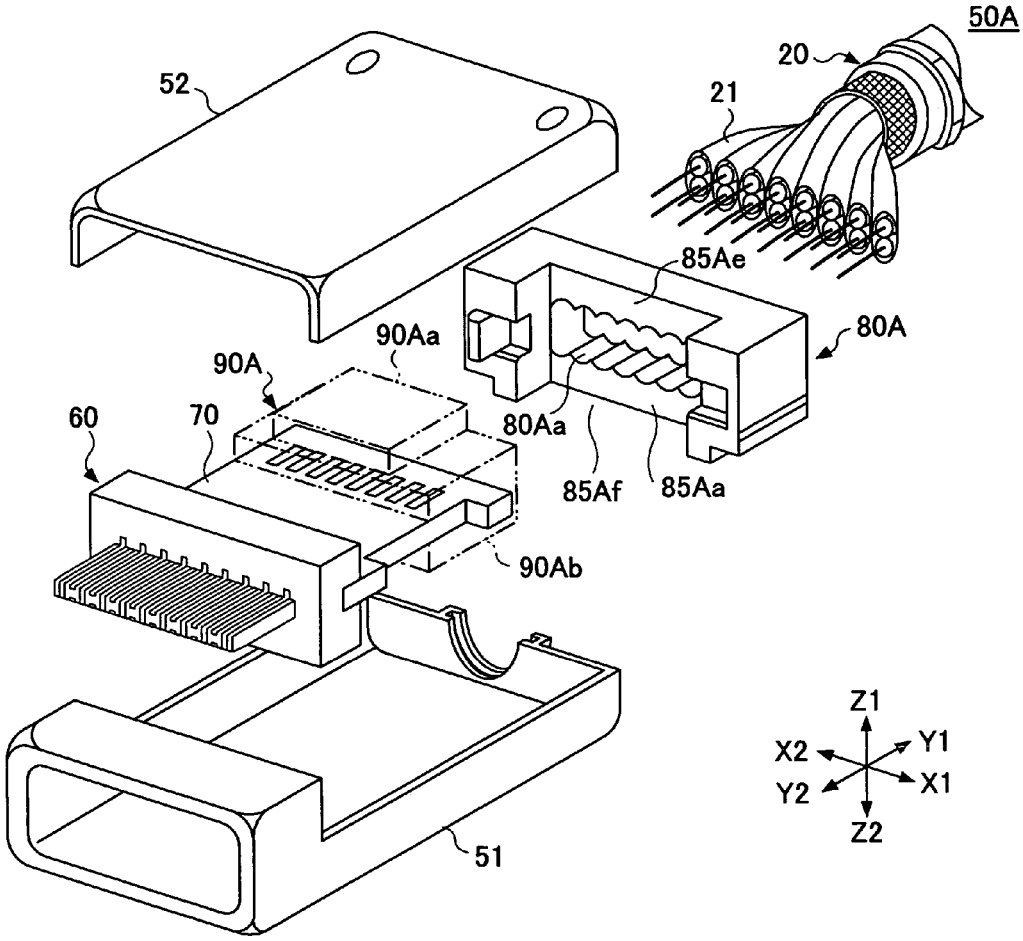
FIG. 9 is an exploded perspective view of a balanced transmission cable connector of a second embodiment of the present invention.
Figure 10:
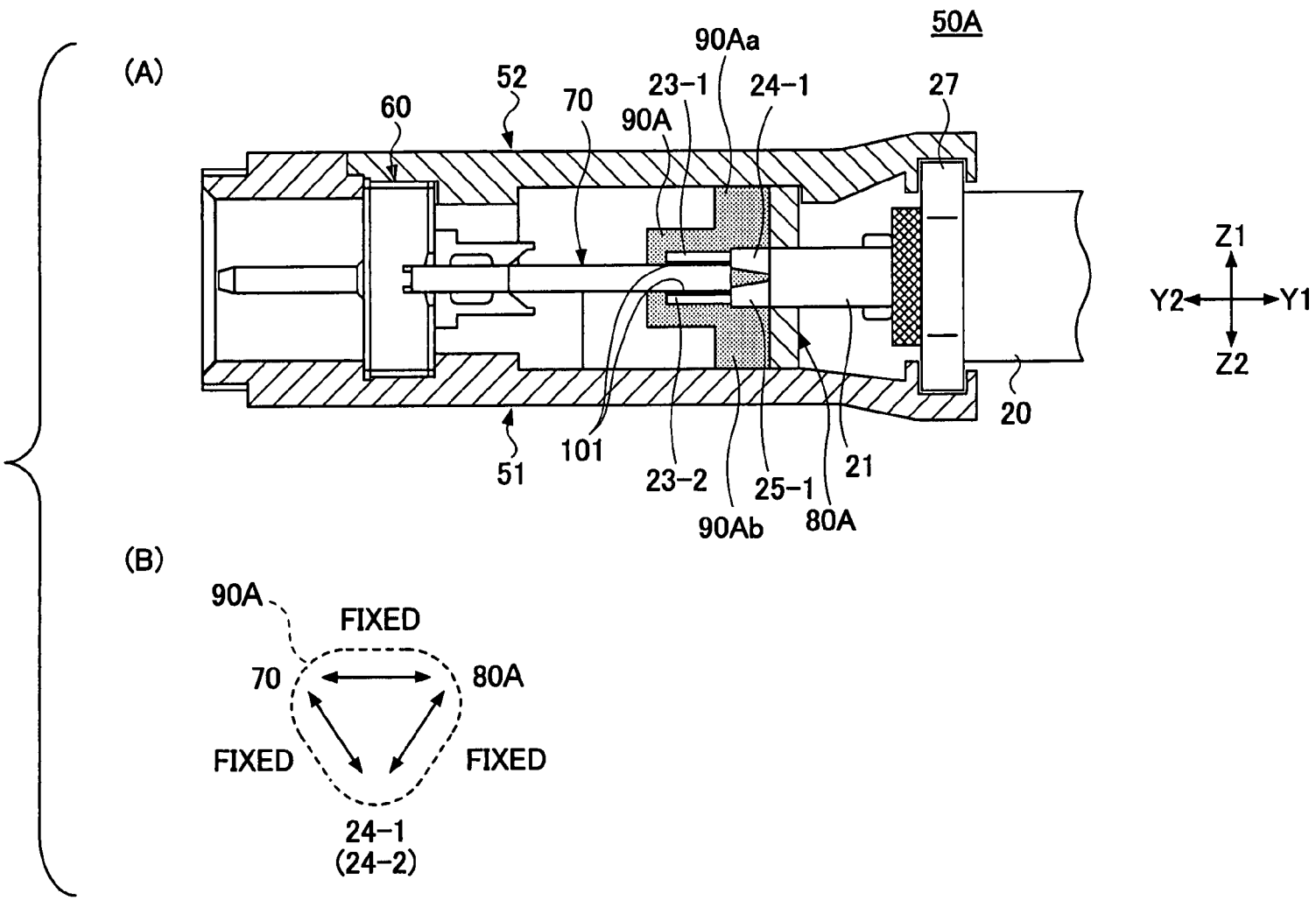
FIG. 10 is a cross-sectional view of the balanced transmission cable connector shown in FIG. 9.

FIG. 9 is an exploded perspective view of a balanced transmission cable connector 50A of a second embodiment of the present invention. FIG. 10 is a cross-sectional view of the balanced transmission cable connector 50A shown in FIG. 10. A configuration of an electric wire arranging member 80A of the cable connector 50A is different from the configuration of the electric wire arranging member 80 of the cable connector 50 shown in FIG. 4 and FIG. 5. Hence, a configuration of a synthetic resin part 90A for reinforcing in the second embodiment is different from the configuration of the synthetic resin part 90 for reinforcing in the first embodiment.

The electric wire arranging member 80A has a structure where the Z1 side flange 86 and the Z2 side flange 87 of the electric wire arranging member 80 shown in FIG. 4 are removed and opening parts 85Ae and 85Af are formed at the Z1 and Z2 sides, respectively. The opening parts 85Ae and 85Af communicated the opening 85Aa. The synthetic resin part 90A for reinforcing has parts 90Aa and 90Ab which are projected in Z1 and Z2 directions, respectively, and which engage with the opening parts 85Ae and 85Af in addition to the opening 85Aa.

As shown in FIG. 10-(B), the relay board 70, the electric wire arranging member 80A, the end parts of the covering parts 24-1 and 24-2 of the first and second covered electric signal wires 22-1 and 22-2 are fixed each other. That is, the end parts of the covering parts 24-1 and 24-2 are fixed to both the relay board 70 and the electric wire arranging member 80A. The electric wire arranging member 80A is fixed to the relay board 70.

Since the opening part 85Ae and 85Af are provided at the Z1 and Z2 sides, it is possible for the thermoplastic resin to enter into the electric wire arranging member 80A.

Figure 11:
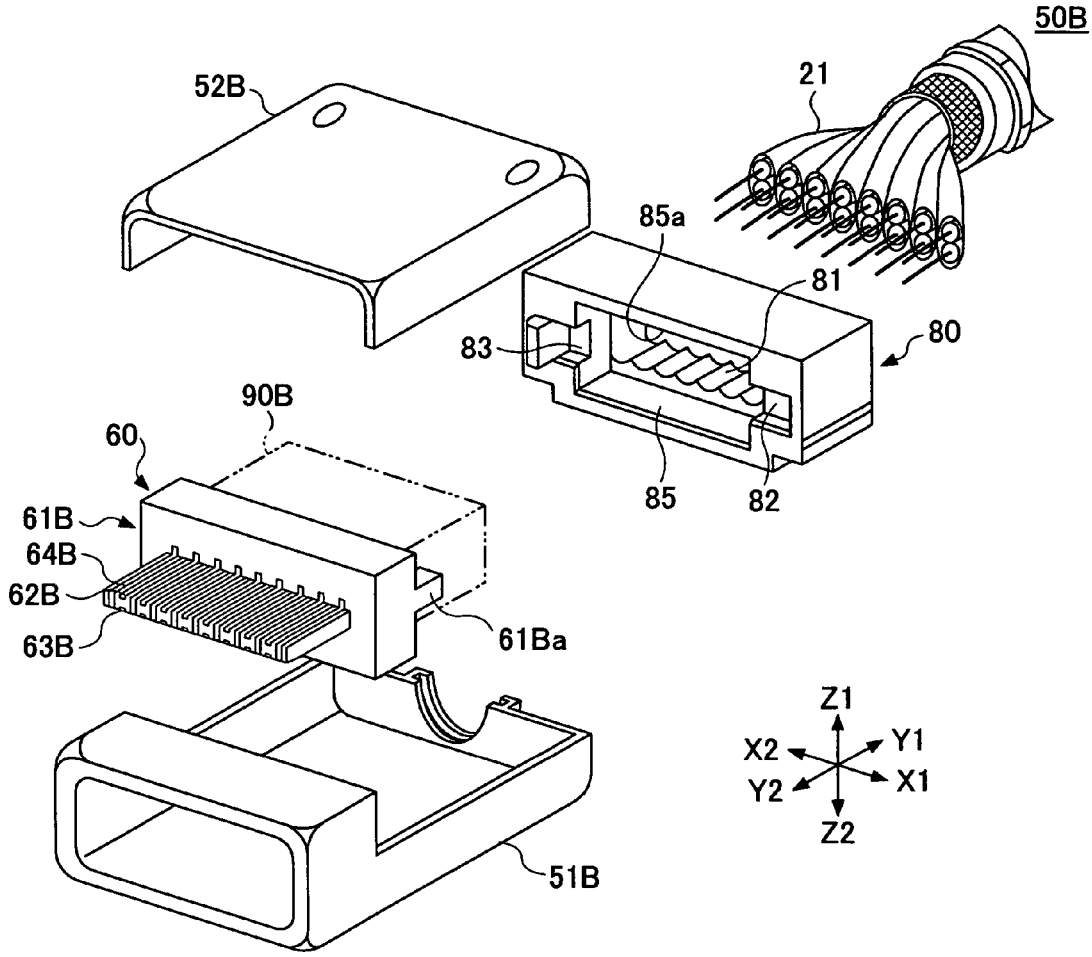
FIG. 11 is an exploded perspective view of a balanced transmission cable connector of a third embodiment of the present invention.
Figure 12:
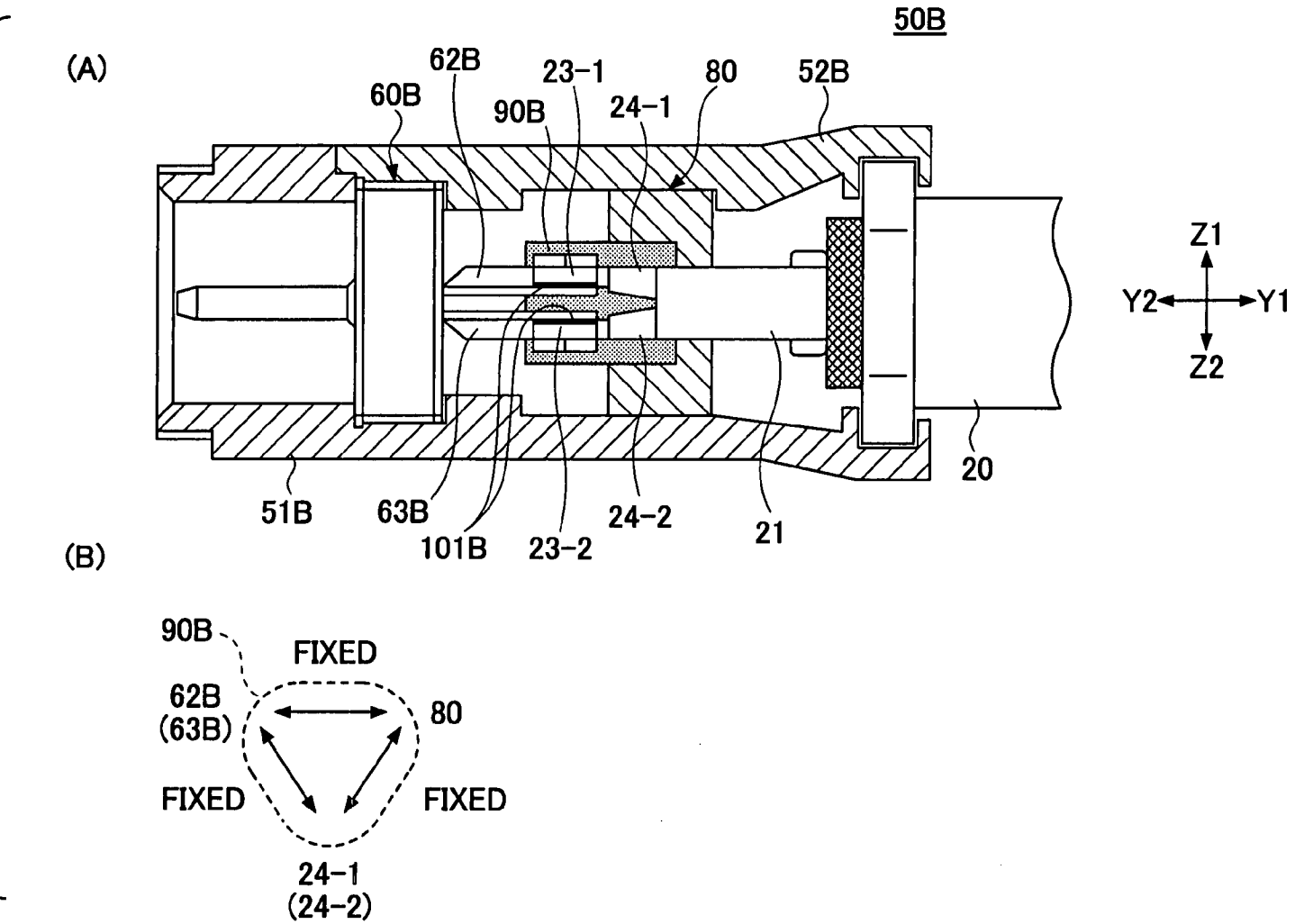
FIG. 12 is a cross-sectional view of the balanced transmission cable connector shown in FIG. 11.

FIG. 11 is an exploded perspective view of a balanced transmission cable connector 50B of a third embodiment of the present invention. FIG. 12 is a cross-sectional view of the balanced transmission cable connector 50B shown in FIG. 11. The cable connector 50B is different from the cable connector 50 shown in FIG. 4 in that the cable connector 50B does not have the relay board 70.

The signal wires 23-1 and 23-2 and the drain wire 26 are directly soldered to the Y1 side ends of the signal contacts 62B and 63B of the contact assembly body 60B and the ground contact 64B. A numerical reference 101B is a solder connecting part.

The electric wire arranging member 80 is engaged and connected with arm parts 61Ba situated at both sides of the block body 61B. The synthetic resin 90B for reinforcing covers the Y1 side ends of the signal contacts 62B and 63B and the ground contact 64B and the solder connecting part 101B. The synthetic resin 90B for reinforcing also fills inside of the third concave part 85 and covers end parts of the covering parts 24-1 and 24-2. As shown in FIG. 12-(B), the signal contacts 62B and 63B, the electric wire arranging member 80, and the covering parts 24-1 and 24-2 of the first and second covering signal electric wires 22-1 and 22-2 are fixed to each other by the synthetic resin 90B for reinforcing. That is, the end parts of the covering parts 24-1 and 24-2 are fixed to both the signal contacts 62B and 63B and the electric wire arranging member 80.

Therefore, in a case where the balanced transmission cable 20 is curved during the use of the cable connector 50B, even if a pulling force of a certain electric wire pair 21 is transferred to even the inside of the balanced transmission cable connector 50B via the clamp member 27, the pulling force is received by head end parts of the covering parts 24-1 and 24-2 of the first and second covered electric signal wires 22-1 and 22-2. Therefore, the pulling force does not reach the solder connecting part 101B.

Furthermore, the arranging member 80 does not independently slide against the signal contacts 62B and 63B and the ground contacts 64B. A stress to the soldering part due to the arranging member 80 independently sliding against the contacts 62B, 63B and 64B does not occur. Therefore, the balanced transmission cable connector 50B has a higher reliability regarding the solder connection part 101B than the related art connectors.

The present invention is not limited to these embodiments, but variations and modifications may be made without departing from the scope of the present invention.

For example, an electrical connection between the signal wires 23-1 and 23-2 and the drain wire 26 and mechanical equipment may be not related to soldering but also electrical welding. Furthermore, the present invention is not limited to the balanced transmission cable connector but can be applied to a cable connector where ends of normal cables are arranged for connecting.

This patent application is based on Japanese Priority Patent Application No. 2004-51973 filed on Feb. 26, 2004, and the entire contents of which are hereby incorporated by reference.

What is claimed is:

1. A cable connector, comprising:

a contact assembly body having a structure where a contact is provided in an electric insulating block body;

a relay board connected to the contact and provided at a back surface of the contact assembly body; and an electric wire arranging member which is provided at an end of the relay board and which is configured to arrange a plurality of covered electric wires extending from an end of a cable, wherein a wire which extends from an end of an electric insulating covering part of the covered electric wire is provided at an end of the cable to mechanically and electrically connect to the relay board, the electric wire arranging member includes a synthetic resin receiving part configured to receive molten synthetic resin, the electric wire arranging member includes an electric wire pair arranging part which arranges a plurality of covered electric wire pairs, the electric wire pair arranging part has a pair of half arc parts facing each other and forming a configuration corresponding to a cross-sectional configuration of the covered electric wire pairs, the synthetic resin receiving part is provided at a side of the electric wire arranging member, a synthetic resin reinforcing part is formed in the synthetic resin receiving part by solidifying the molten synthetic resin, and the synthetic resin reinforcing part covers a part of the relay board where the wire is connected, and fixes the end of the electric insulating covering part of the covered electric wire to the relay board.

2. The cable connector as claimed in claim 1, wherein the synthetic resin receiving part of the electric wire arranging member has openings formed at upper and lower sides of said synthetic resin receiving part.

3. A cable connector, comprising:

a contact assembly body having a structure where a contact is provided in an electric insulating block body; and an electric wire arranging member which is provided at a back surface of the contact assembly body and which is configured to arrange a plurality of covered electric wires extending from an end of a cable, wherein a wire which extends from an end of an electric insulating covering part of the covered electric wire is provided at an end of the cable to mechanically and electrically connect to the contact of the contact assembly body, the electric wire arranging member includes a synthetic resin receiving part configured to receive molten synthetic resin, the electric wire arranging member includes an electric wire pair arranging part which arranges a plurality of covered electric wire pairs, the electric wire pair arranging part has a pair of half arc parts facing each other and forming a configuration corresponding to a cross-sectional configuration of the covered electric wire pairs, the synthetic resin receiving part is provided at a side of the electric wire arranging member, a synthetic resin reinforcing part is formed in the synthetic resin receiving part by solidifying the molten synthetic resin, and the synthetic resin reinforcing part covers a part of the relay board where the wire is connected, and fixes the end of the electric insulating covering part of the covered electric wire to the relay board.

4. The cable connector as claimed in claim 3, wherein the synthetic resin receiving part of the electric wire arranging member has openings formed at upper and lower sides of said synthetic resin receiving part.

5. A cable connector, comprising:

a contact assembly body having a structure where first and second signal contacts and a ground contact are provided in parallel one by one in an electric insulating block body;

a relay board connected to the first and second signal contacts and the ground contact and provided at a back surface of the contact assembly body; and an electric wire arranging member which is provided at an end of the relay board, and which is configured to arrange a plurality of electric wire pairs extending from an end of a cable, the electric wire pairs being formed by first and second covered electric signal wires and a drain wire, and having a structure where first and second signal wires are extended from an end of an electric insulating covering part of the first and second covered electric signal wires, irrespectively, wherein the first and second signal wires and the drain wire which extend from an end of the arranged electric wire pairs mechanically and electrically connect to an end of the relay board, the electric wire arranging member includes a synthetic resin receiving part configured to receive molten synthetic resin, the electric wire arranging member includes an electric wire pair arranging part which arranges a plurality of covered electric wire pairs, the electric wire pair arranging part has a pair of half arc parts facing each other and forming a configuration corresponding to a cross-sectional configuration of the covered electric wire pairs, the synthetic resin receiving part is provided at a side of the electric wire arranging member, a synthetic resin reinforcing part is formed in the synthetic resin receiving part by solidifying the molten synthetic resin, and the synthetic resin reinforcing part covers a part of the relay board where the wires are connected, and fixes the end of the covering part of the first and second covered signal electric wires to the relay board.

6. The cable connector as claimed in claim 5, wherein the synthetic resin receiving part of the electric wire arranging member has openings are at upper and lower sides of said synthetic resin receiving part.

7. A cable connector, comprising:

a contact assembly body having a structure where first and second signal contacts and a ground contact are provided in parallel one by one in an electric insulating block body and an electric wire arranging member which is provided at back surface of the contact assembly body, and which is configured to arrange a plurality of electric wire pairs extending from an end of a cable having a structure where the electric wire pairs formed by first and second covering electric signal wires and a drain wire are provided and first and second signal wires are extended from an end of an electric insulating covering part of the first and second covering electric signal wires, respectively, wherein the first and second signal wires and the drain wire, which extend from an end of the arranged pair electric wire, mechanically and electrically connect to ends of the first and second signal contact and the ground contact, respectively, the electric wire arranging member includes a synthetic resin receiving part configured to receive molten synthetic resin, the electric wire arranging member includes an electric wire pair arranging part which arranges a plurality of covered electric wire pairs, the electric wire pair arranging part has a pair of half arc parts facing each other and forming a configuration corresponding to a cross-sectional configuration of the covered electric wire pairs, the synthetic resin receiving part is provided at a side of the electric wire arranging member, a synthetic resin reinforcing part is formed in the synthetic resin receiving part by solidifying the molten synthetic resin, and the synthetic resin reinforcing part covers a part of the relay board where the wires are connected, and fixes the end of the covered part of the first and second covered electric signal wires to the first and second signal contacts and the ground contact.

8. The cable connector as claimed in claim 7, wherein the synthetic resin receiving part of the electric wire arranging member has openings formed at upper and lower sides of said synthetic resin receiving part.

9. A cable connector, comprising:

a relay board connected to the contact and provided at a back surface of a contact assembly body; and an electric wire arranging member, including an electric wire pair arranging part arranging a plurality of covered electric wire pairs by providing a pair of half arc parts facing each other and forming a configuration corresponding to a cross-sectional configuration of the covered electric wire pairs, provided at an end of the relay board and configured to arrange a plurality of covered electric wire pairs extending from an end of a cable, wherein wires extending from an end of the covered electric wire pairs are provided at an end of the cable to mechanically and electrically connect to the relay board, and a synthetic resin reinforcing part, formed in a synthetic resin receiving part, covers a part of the relay board where the wires are connected, and fixes the end of the electric insulating covering part of the covered electric wire pairs to the relay board.

10. The cable connector as claimed in claim 9, wherein the synthetic resin receiving part has openings formed at upper and lower sides of said synthetic resin receiving part.

* * * * *

UNITED STATES PATENT AND TRADEMARK OFFICE

CERTIFICATE OF CORRECTION

PATENT NO. : 6,984,150 B2
APPLICATION NO. : 10/901983
DATED : January 10, 2006
INVENTOR(S) : Takahiro Kondou et al.

It is certified that error appears in the above-identified patent and that said Letters Patent is hereby corrected as shown below:

Column 9,
Line 61, after "block body" insert -- ; --.

Signed and Sealed this

Twenty-fifth Day of July, 2006

JON W. DUDAS
*Director of the United States Patent and Trademark Office*